US008887548B1

(12) United States Patent
Price et al.

(10) Patent No.: US 8,887,548 B1
(45) Date of Patent: Nov. 18, 2014

(54) LAND MINE SIMULATOR

(75) Inventors: Brian L. Price, Panama City Beach, FL (US); Patrick A. Delay, Panama City Beach, FL (US); Mark Welscher, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 318 days.

(21) Appl. No.: 13/591,624

(22) Filed: Aug. 22, 2012

(51) Int. Cl.
*G01L 25/00* (2006.01)
*F41A 31/00* (2006.01)
*F41H 11/13* (2011.01)
*G01M 99/00* (2011.01)

(52) U.S. Cl.
USPC ..... 73/1.15; 73/118.01; 73/167; 73/866.4; 102/402

(58) Field of Classification Search
CPC ..... F41A 31/00; F41H 11/13; F41H 11/138; G01L 25/00; G01M 99/007
USPC ..... 73/1.13, 1.15, 118.01, 167, 866.4; 89/1.13; 102/402; 434/11
See application file for complete search history.

(56) References Cited

U.S. PATENT DOCUMENTS 4,850,276 A * 7/1989 Olofsson et al. ..... 102/401
6,553,912 B2 * 4/2003 Wygant ..... 434/11 X
2008/0092725 A1 * 4/2008 Simula et al. ..... 89/1.13
2011/0146370 A1 * 6/2011 Glaser ..... G01L 25/00
2012/0123701 A1 * 5/2012 Drueding et al. ..... 702/41
2013/0115574 A1 * 5/2013 Hatcher ..... 434/11

FOREIGN PATENT DOCUMENTS

DE 301439 A7 * 1/1993 ..... B63G 7/04
JP 04281200 A * 10/1992 ..... F42B 8/28
JP 2005195287 A * 7/2005 ..... F41H 11/12
JP 2011163683 A * 8/2011 ..... F42B 8/28
JP 2011163684 A * 8/2011 ..... F42B 8/28

* cited by examiner

*Primary Examiner* — Thomas P Noland
(74) *Attorney, Agent, or Firm* — James T. Shepherd

(57) ABSTRACT

A land mine simulator includes a housing having an opening formed in one end thereof. A plate movably supported in the housing's opening has a first face exposed to a surrounding environment and a second face exposed to an interior region of the housing. A non-compressible fluid-filled reservoir in the housing includes a flexible diaphragm opposing and spaced apart from the second face of the plate. Plungers are between each of the second face of the plate and the diaphragm. Each of one or more air spring in the housing includes a cylinder having a movable piston sealed therein with a first side of the piston in fluid communication with the reservoir's fluid and a second side of the piston in fluid communication with a pressurized volume of gas within the cylinder. A pressure sensor is provided in communication with the fluid in the reservoir.

20 Claims, 2 Drawing Sheets

LAND MINE SIMULATOR

ORIGIN OF THE INVENTION

The invention described herein may be manufactured and used by or for the Government of the United States of America for Governmental purposes without payment of any royalties.

FIELD OF THE INVENTION

The invention relates generally to ordnance simulators, and more particularly to a land mine simulator.

BACKGROUND OF THE INVENTION

The testing of land mine clearance and/or protection devices/systems has traditionally utilized live land mine ordnance. Obviously, this type of testing is inherently dangerous for personnel, the devices or systems under test, and the testing environment.

SUMMARY OF THE INVENTION

Accordingly, it is an object of the present invention to provide a land mine simulator for non-destructive testing of mine clearing and/or protection for devices/systems.

Other objects and advantages of the present invention will become more obvious hereinafter in the specification and drawings.

In accordance with the present invention, a land mine simulator includes a housing having an opening formed in one end thereof. A rigid plate is movably supported in the housing's opening. The plate has a first face adapted to be exposed to a surrounding environment and a second face exposed to an interior region of the housing. A reservoir disposed in the housing includes a flexible diaphragm opposing and spaced apart from the second face of the plate. Plungers are disposed between and in contact with each of the second face of the plate and the diaphragm. A non-compressible fluid fills the reservoir. At least one air spring is disposed in the housing. Each such air spring includes a cylinder having a movable piston sealed therein with a first side of the piston being in fluid communication with the fluid in the reservoir and a second side of the piston being in fluid communication with a pressurized volume of gas within the cylinder. A pressure sensor is provided in fluid communication with the fluid in the reservoir.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
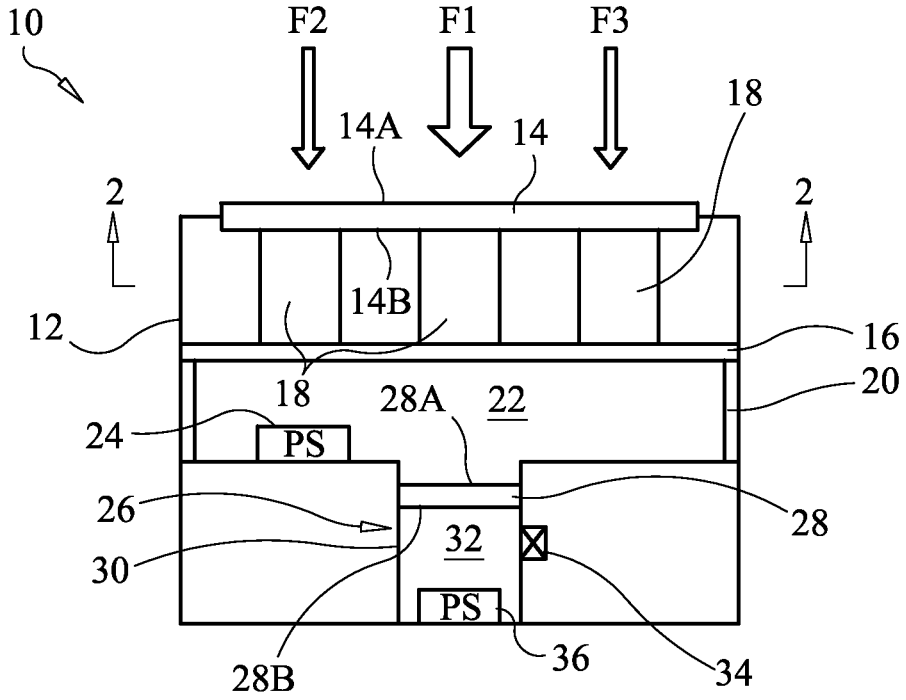
FIG. 1 is a schematic diagram of a land mine simulator in accordance with an embodiment of the present invention.

Referring now to the drawings and more particularly to FIG. 1, a land mine simulator in accordance with an embodiment of the present invention is shown and is referenced generally by numeral 10. In general, simulator 10 is capable of measuring a force applied to the top thereof. The force can be applied evenly across the whole top of simulator 10 as indicated by force arrow F1, or can be applied unevenly just at some portion of the top of simulator 10 as indicated by force arrows F2 and F3.

Simulator 10 includes an outer rigid housing 12 that can be cylindrical as in the illustrated embodiment. Housing 12 is open at the top thereof for the movable support of a rigid pressure plate 14. A top surface 14A of pressure plate 14 faces outward to receive a force (e.g., force F1, F2, F3, etc.) to be measured by simulator 10. A bottom surface 14B of pressure plate 14 faces into housing 12.

Figure 2:
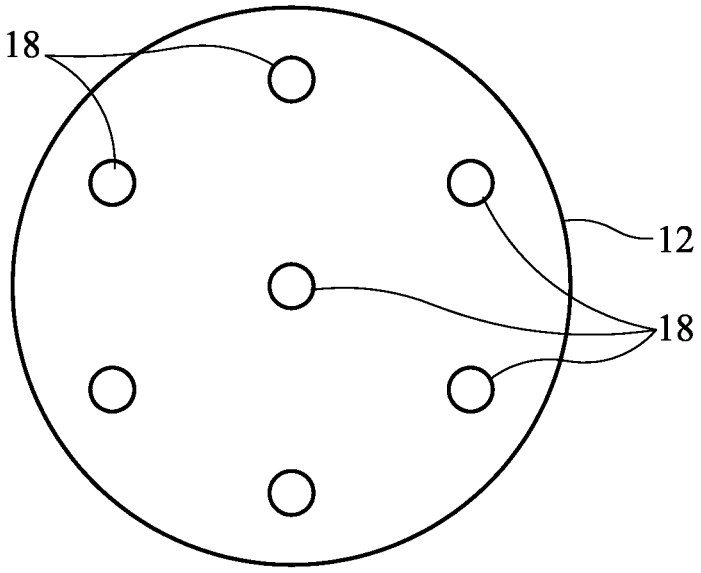
FIG. 2 is a sectional view of the land mine simulator taken along line 2-2 in FIG. 1 illustrating the plunger dispersion pattern in accordance with an embodiment of the present invention.

Mounted within housing 12 some distance from bottom surface 14B is a flexible diaphragm 16. A number of plungers 18 are disposed/positioned between bottom surface 14B and diaphragm 16. More specifically, each of plungers 18 is in contact with the bottom surface 14B and diaphragm 16. The particular size/shape, number and arrangement of plungers 18 are not limitations of the present invention. However, by way of illustrative example, an arrangement of plungers 17 is illustrated in FIG. 2 where six plungers 18 are arranged in an annular fashion around a seventh/central plunger 18. That is, the central plunger 18 is positioned to contact bottom surface 14B at the center of pressure plate 14 while the other plungers 18 contact bottom surface 14B at contact points dispersed annularly about the center of pressure plate 14.

Diaphragm 16 forms a sealing side of a reservoir 20 that is filled with a non-compressible fluid 22 (e.g., an oil). Diaphragm 16 also serves to transfer any pressure force applied to top surface of 14A of pressure plate 14 through one or more plungers 18 to non-compressible fluid 22. Material used for diaphragm 16 can be any material (e.g., rubber) that will support the sealing and force transfer functions. A pressure sensor ("PS") 24 in fluid communication with fluid 22 records pressure changes in fluid 22 caused by forces applied to top surface of 14A of pressure plate 14. Reservoir 20 is also sealed by the one or more movable pistons of one or more air springs 26 coupled to reservoir 20. More specifically, each air spring 26 has a movable piston 28 sealed in a cylinder 30. One side/face 28A of piston 28 is in fluid communication with fluid 22 in reservoir 20. The other side/face 28B of piston 28 is in fluid communication with a pressurized volume of gas 32 (e.g., air) in cylinder 30.

In operation, when a force (e.g., force F2) is applied to pressure plate 14, the force is transferred by one or more plungers 18 to diaphragm 16. The force is transferred by diaphragm 16 to non-compressible fluid 22 that completely fills reservoir 20 up to the one or more pistons 28 of the one or more air springs 26. Pressure sensor 24 measures the pressure change in fluid 22 and air spring(s) 26 provide a relief to the forces injected, and create a rebound force to re-set the device.

To provide force sensitivity and/or force resolution adjustment, simulator 10 can include a valve 34 in fluid communication with the pressurized volume of gas 32 in cylinder 30. In this way, pre-use gas pressure can be increased or decreased to adjust simulator 10 for a particular application force that is to be measured (e.g., personnel mine, vehicle mine, etc.).

Simulator 10 could also include a second pressure sensor 36 ("PS") on the air side of the device as a means of assuring the device's proper operation. More specifically, pressure sensor 36 is positioned for fluid communication with the pressurized volume of gas 32 in cylinder 30 to indicate when there are changes in pressure in reservoir 20.

Figure 3:
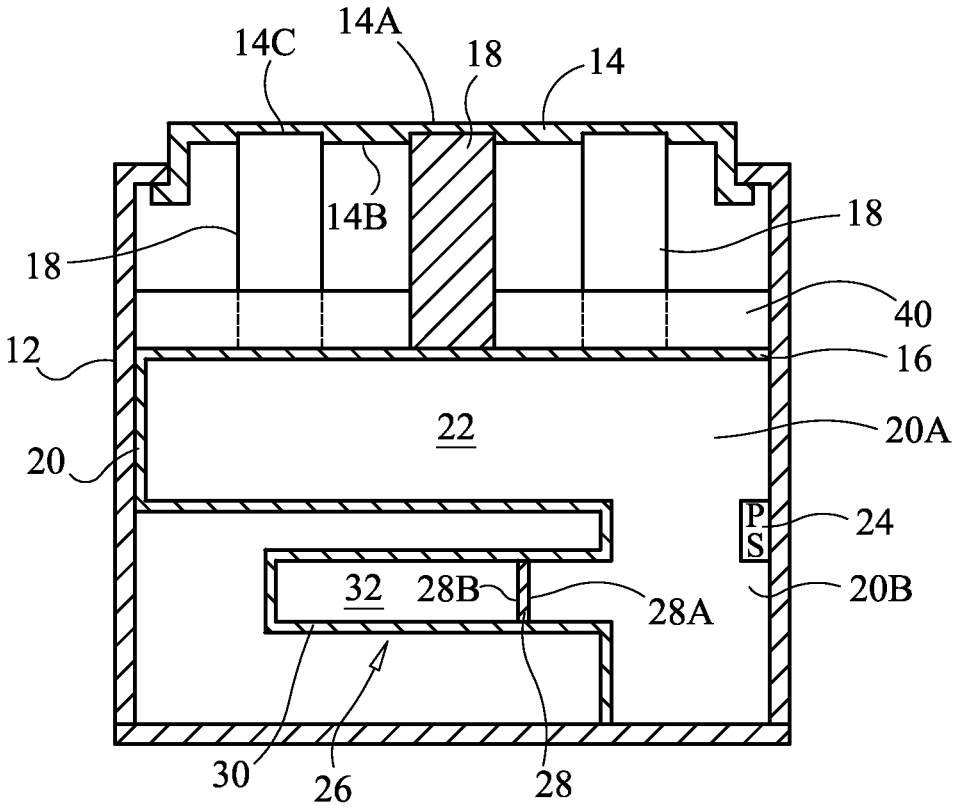
FIG. 3 is a sectional view of a land mine simulator in accordance with an embodiment of the present invention.
Figure 4:
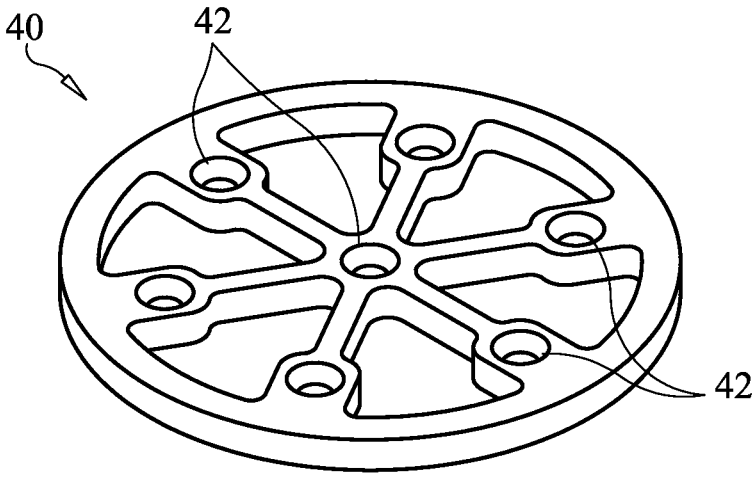
FIG. 4 is a perspective view of a plunger frame in accordance with an embodiment of the present invention.

The above-described land mine simulator can be realized in a variety of ways without departing from the scope of the present invention. By way of example, one such realization is illustrated in a sectional view thereof in FIG. 3 where reference numeral commonality has been maintained where appropriate. Each of plungers 18 is slidably supported for axial movement by a support frame 40 shown in isolation in FIG. 4. Frame 40 defines a number of open-ended sleeves 42 commensurate in number with plungers 18. Frame 40/sleeves 42 define the dispersed arrangement of plungers 18 and maintain plungers 18 in a parallel relationship to one another. Each sleeve 42 provides sliding support of one plunger 18. Frame 40 is mounted in housing 12 just above diaphragm 16. Bottom surface 14B of pressure plate 14 can incorporate recesses 14C receiving the tops of plungers 18 thereby keeping plungers 18 properly aligned regardless of the actual location of force application to top surface 14A. In the FIG. 3 embodiment, reservoir 20 has an upper chamber 20A contiguous with a lower chamber 20B, both of which are filled with non-compressible fluid 22 as described earlier herein. The fluid side of air spring(s) 26 (i.e., side 28A of piston 28) is in fluid communication with fluid 22 in lower chamber 20B. Pressure sensor 24 can be placed in lower chamber 20B.

Although the invention has been described relative to specific embodiments thereof, there are numerous variations and modifications that will be readily apparent to those skilled in the art in light of the above teachings. For example, the land mine simulator could incorporate other sensors (e.g., tilt, temperature, etc.) depending on the information needed for a particular test application. It is therefore to be understood that, within the scope of the appended claims, the invention may be practiced other than as specifically described.

What is claimed as new and desired to be secured by Letters Patent of the United States is:

1. A land mine simulator, comprising:

a housing having an opening formed in one end thereof;

a rigid plate movably supported in said housing at said opening thereof, said plate having a first face adapted to be exposed to a surrounding environment and a second face exposed to an interior region of said housing;

a reservoir disposed in said housing, said reservoir including a flexible diaphragm opposing and spaced apart from said second face of said plate;

a plurality of plungers disposed between and in contact with each of said second face of said plate and said diaphragm;

a non-compressible fluid filling said reservoir;

at least one air spring disposed in said housing, each said air spring including a cylinder having a movable piston sealed therein, wherein a first side of said piston is in fluid communication with said fluid in said reservoir and a second side of said piston is in fluid communication with a pressurized volume of gas within said cylinder; and a pressure sensor in fluid communication with said fluid in said reservoir.

2. A land mine simulator as in claim 1, further comprising a second pressure sensor in fluid communication with said pressurized volume.

3. A land mine simulator as in claim 1, further comprising a valve coupled to said cylinder for facilitating introduction and removal of said gas from said pressurized volume.

4. A land mine simulator as in claim 1, wherein said gas comprises air.

5. A land mine simulator as in claim 1, wherein said non-compressible fluid comprises oil.

6. A land mine simulator as in claim 1, further comprising a rigid frame mounted in said housing, said frame defining a plurality of sleeves in correspondence with said plurality of plungers, each of said sleeves providing sliding support for one of said plungers.

7. A land mine simulator as in claim 1, wherein said plungers are disposed to contact said second face of said plate in a dispersed pattern of contacts.

8. A land mine simulator as in claim 7, wherein said dispersed pattern of contacts is defined by a contact at a center of said second face and remaining contacts dispersed annularly about said center of said second face.

9. A land mine simulator, comprising:

a housing having an opening formed in one end thereof;

a rigid plate movably supported in said housing at said opening thereof, said plate having a first face adapted to be exposed to a surrounding environment and a second face exposed to an interior region of said housing;

a reservoir disposed in said housing, said reservoir including a flexible diaphragm opposing and spaced apart from said second face of said plate;

a plurality of plungers disposed between and in contact with each of said second face of said plate and said diaphragm;

a non-compressible fluid filling said reservoir;

at least one adjustable air spring disposed in said housing, each said adjustable air spring including a cylinder having a movable piston sealed therein, wherein a first side of said piston is in fluid communication with said fluid in said reservoir and a second side of said piston is in fluid communication with an adjustable-pressure volume of gas within said cylinder;

a first pressure sensor in fluid communication with said fluid in said reservoir; and a second pressure sensor in fluid communication with said adjustable-pressure volume.

10. A land mine simulator as in claim 9, wherein said gas comprises air.

11. A land mine simulator as in claim 9, wherein said non-compressible fluid comprises oil.

12. A land mine simulator as in claim 9, further comprising a rigid frame mounted in said housing, said frame defining a plurality of sleeves in correspondence with said plurality of plungers, each of said sleeves providing sliding support for one of said plungers.

13. A land mine simulator as in claim 9, wherein said plungers are disposed to contact said second face of said plate in a dispersed pattern of contacts.

14. A land mine simulator as in claim 13, wherein said dispersed pattern of contacts is defined by a contact at a center of said second face and remaining contacts dispersed annularly about said center of said second face.

15. A land mine simulator, comprising:

a housing having an opening formed in one end thereof;

a rigid plate movably supported in said housing at said opening thereof, said plate having a first face adapted to be exposed to a surrounding environment and a second face exposed to an interior region of said housing;

a reservoir disposed in said housing, said reservoir including a flexible diaphragm opposing and spaced apart from said second face of said plate;

a plurality of plungers disposed between and in contact with each of said second face of said plate and said diaphragm;

a rigid frame mounted in said housing, said frame defining a plurality of parallel sleeves in correspondence with said plurality of plungers, each of said sleeves providing sliding support for one of said plungers, said sleeves being arranged in a dispersed pattern;

a non-compressible fluid filling said reservoir;

at least one air spring disposed in said housing, each said air spring including a cylinder having a movable piston sealed therein, wherein a first side of said piston is in fluid communication with said fluid in said reservoir and a second side of said piston is in fluid communication with a pressurized volume of gas within said cylinder; and a pressure sensor in fluid communication with said fluid in said reservoir.

16. A land mine simulator as in claim 15, further comprising a second pressure sensor in fluid communication with said pressurized volume.

17. A land mine simulator as in claim 15, further comprising a valve coupled to said cylinder for facilitating introduction and removal of said gas from said pressurized volume.

18. A land mine simulator as in claim 15, wherein said gas comprises air.

19. A land mine simulator as in claim 15, wherein said non-compressible fluid comprises oil.

20. A land mine simulator as in claim 15, wherein said dispersed pattern is defined by a central one of said sleeves and remaining ones of said sleeves dispersed annularly about said central one of said sleeves.

* * * * *